United States Patent [19]

Wells

[11] Patent Number: 4,829,311

[45] Date of Patent: May 9, 1989

[54] HIGH IMPEDANCE, BASE LOADED, WHIP ANTENNA

[76] Inventor: Donald H. Wells, 7134 Railroad St., Holland, Ohio 43528

[21] Appl. No.: 168,927

[22] Filed: Mar. 16, 1988

[51] Int. Cl.[4] ..... H01Q 1/00

[52] U.S. Cl. ..... 343/749; 343/715; 343/722; 343/888; 343/906

[58] Field of Search ..... 343/715, 722, 749, 750, 343/752, 878, 888, 866, 867, 895, 900, 906; 174/138 A, 152 A, 153 A

[56] References Cited

U.S. PATENT DOCUMENTS

| | | | |
|---|---|---|---|
| 3,176,298 | 3/1965 | Nettles | 343/722 |
| 3,408,652 | 10/1968 | Allisbaugh | 343/715 |
| 4,190,839 | 2/1980 | Liautaud | 343/749 |
| 4,238,800 | 12/1980 | Newington | 343/749 |
| 4,259,672 | 3/1981 | Newcomb | 343/750 |

*Primary Examiner*—William L. Sikes
*Assistant Examiner*—Michael C. Wimer
*Attorney, Agent, or Firm*—William P. Hickey

[57] ABSTRACT

An antenna construction having a whip supporting sleeve with a depending support pin that is received in a socket in an antenna support sleeve, and with an insulator in the socket electrically separating the support pin from the support sleeve but providing a predetermined capacitance therebetween. The insulator rigidly connects the support pin to the support sleeve to resist lateral loads on the whip in a manner preventing cracking of the insulator. The antenna includes a structural inductance in parallel with the built in pin-socket capacitance to allow a shorter whip at resonance than the prior art base loaded antenna.

3 Claims, 1 Drawing Sheet

HIGH IMPEDANCE, BASE LOADED, WHIP ANTENNA

TECHNICAL FIELD

The present invention relates to the construction of a transmitting whip antenna that can be subjected to high electrical and physical shock loads, and which has an electrical length greater than its physical length, such as is desirable in high powered mobile whip antennas of a quarter wave length.

BACKGROUND OF THE INVENTION

Mobile antennas built for mounting on trucks, tanks, etc. must be designed and installed to pass under bridges etc. having less than approximately 14 feet road clearance. A problem has occurred when these antennas strike a bridge etc. when the antenna is moving at a high rate of speed. Antennas for the 27 mHZ band for example produce a wave length of about 32 feet. A half wave length is impractical for a vertical whip, and a quarter wave length must have an electrical length of about 96 inches. Quarter wave length antennas must be attached above a metal structure in which a mirror image quarter wave is produced, so for many applications, even the quarter wave length antenna must be physically shortened for mobile use by using a loading inductance to give the antenna a proper impedance to match the driving equipment. It is desired therefore to produce a rugged antenna whose point of attachment has an impedance of approximately 50 ohms. All prior art base loaded antennas of which I am familar only have an impedance of approximately 30 ohms.

The prior art with which I am familar produces a quarter wave length antenna having 50 ohms impedance by separating a top whip of approximately 24 inches, from a lower whip of approximately 18 inches by a 6 inch plastic connector surrounded by an inductance. The inductance gives the two sections of whip the necessary electrical length, and the impedance coil must be inserted in the center section of the antenna in order to give its lower end attachment the desired 50 ohms.

An object of the present invention therefore is the provision of a new and improved base loaded whip antenna having approximately 50 ohms impedance, and which is rugged in construction, efficient in its operation, and inexpensive to manufacture.

Further objects and advantages will become apparent to those skilled in the art to which the invention relates from the following description of the preferred embodiment described with reference to the accompanying drawings forming a part of this specification.

BRIEF SUMMARY OF THE INVENTION

According to principles of the present invention, a pin and sleeve connection is provided between the antenna support and a single section of radiating whip. An insulator of exceedingly high dielectric strength is provided between the sleeve and pin to withstand the exceedingly high voltage loading that is produced at this location in the antenna, and an impedance coil is produced extending from a point below the pin to a point above the pin and surrounding the sleeve. This combination makes possible a shorter whip than has been possible with prior art antennas capable of handling several killowatts of power, it reduces the amount of inductance required, and effectively reinforces the insulator section across which the loading coil must be connected to thereby make possible a much more rugged base loaded whip antenna.

DESCRIPTION OF THE PREFERRED EMBODIMENT

Figure 1:
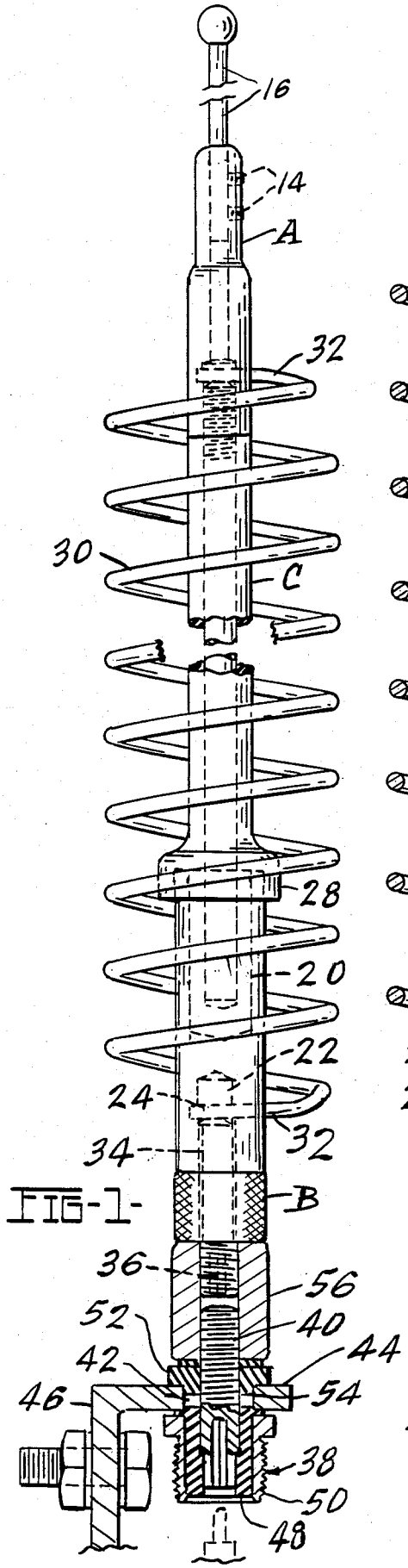
FIG. 1 is a side view of an antenna embodying principles of the present invention and having its lower end sectioned to better depict its mounting.

The embodiment of the invention shown in the drawing generally comprises a whip receiving or attachment sleeve A, and a mounting sleeve B, that are separated by an insulating tube C.

The whip receiving sleeve A has a stepped bore 10, therethrough, the upper end of which is just large enough to receive the whip and the lower end of which is larger in diameter and threaded to receive the threaded end of a support pin 12, later to be described in detail. Two lateral threaded openings 14 into the small diameter upper end of bore 10 are provided for set screws, not shown, which clamp the lower end of the antenna whip 16 into the whip receiving sleeve A. Sleeve A also has another lateral bore 18 which enters the upper end of the large diameter portion of stepped bore 10 and which goes part way into the opposite side wall of the sleeve.

The mounting sleeve B has a large diameter axially extending bore 20 in its upper end, and a smaller axially extending threaded bore 22 in its lower end. The mounting sleeve B also has a laterally extending bore 24 which extends through one side wall of the sleeve to enter the axially extending threaded bore 22, and which bore 24 proceeds part way into the opposite side wall of sleeve B.

The insulating tube C has an axially extending opening 26 that is just large enough to receive the support pin 12 and which opening 26 is closed at its lower end. The outside diameter of the insulating tube C has a press fit with respect to axially extending bore 20 of mounting sleeve B. The insulating tube C has an external inverted cup shaped flange 28 adapted to extend over and seal off the upper end of the mounting sleeve B.

Figure 2:
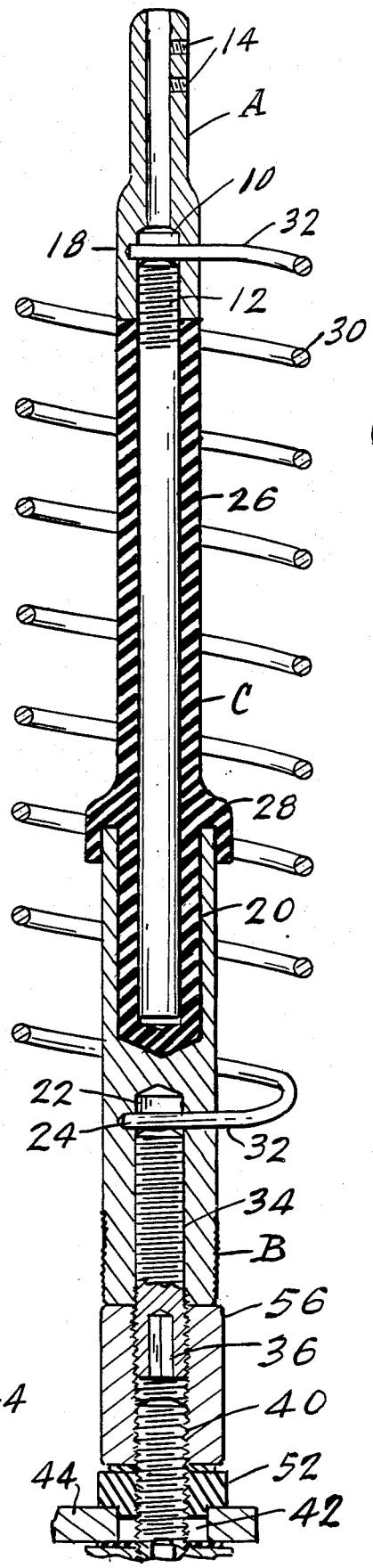
FIG. 2 is a vertical sectional view of the antenna shown in FIG. 1.
Figure 3:
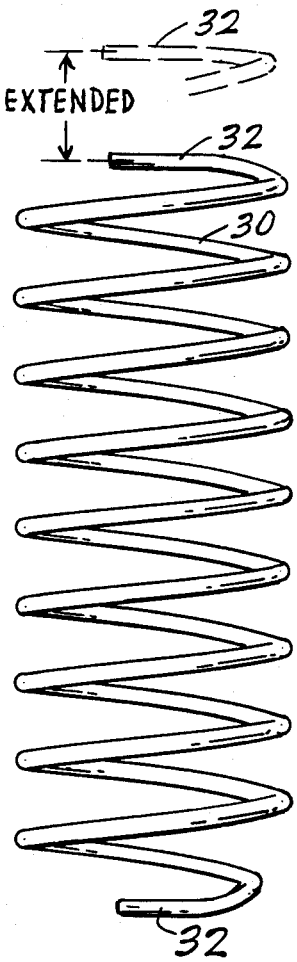
FIG. 3 is a side view of the impedance coil shown in its unstretched condition.

The antenna further includes a helically wound conductor forming an impedance coil 30 comprising nine turns of heavy gauge wire with laterally inwardly turned legs 32 at both of its ends. FIG. 3 shows the normal, as formed, length of the coil; and FIG. 2 shows it in its extended, installed condition as will later be explained.

The antenna so far described is assembled by inserting the upper leg 32 of the coil 30 into the lateral opening 18 so that the leg 32 is supported by both sidewalls of sleeve A. Thereafter the pin 12 is threaded into the opening 10 to abut the leg 32, and lock it in place. The projecting portion of pin 12 is coated with an adhesive, as is the outer surface of insulating tube or sleeve C beneath its cup shaped flange 28. Thereafter the bottom end of the tube C is inserted into the opening 20, and the assembly is forced together until whip receiving sleeve A abuts the upper end of tube C and the inverted cup shaped flange 28 abuts the upper end of mounting sleeve B. During this telescoping of the parts, the coil 30 also telescopes over the mounting sleeve B with its bottom leg 32 falling short of the receiving opening 24. Thereafter the bottom leg 32 is pulled downwardly and forced into the receiving opening 24. The coil thereafter acts as a spring to hold the assembly together while the adhesive hardens or sets. To hold the leg 32 in place a mounting stud 34 having an allen wrench receiving opening 36 is tightened against leg 32 to lock it in place and provide a mounting stud for the assembly.

The antenna is electrically driven from a coaxial cable connector 38 having a center terminal stud 40 which projects up through an opening 42 in the horizontal leg 44 of an angle iron mounting bracket 46. The lower end of the center terminal stud 40 is supported in a plastic insulator 48 that is in turn received in the usual externally threaded barrel 50 for receiving the nut, not shown, of a coaxial cable connector, also not shown. The upper hexagonally shaped flange of the barrel 50 is positioned against the bottom of angle iron leg 44, and a plastic insulating washer 52 is positioned around the terminal stud 40 against the top of the bracket leg 44. The insulating washer 52 has a short tubular projection 54 which projects down into the opening 42 and centers the stud 40 in the opening 42 to isolate the stud from the support bracket 46. An internally threaded coupling sleeve 56 is screwed down onto the upper end of the terminal stud 40 against the insulating washer 52, and the mounting stud 34 of the mounting sleeve B is screwed into the upper end of the coupling sleeve 56 to lock the assembly onto the angle iron mounting bracket 46.

It will now be seen that the signal from the center conductor of a coaxial power cable, not shown, is fed up through the center terminal stud 40 to the coupling sleeve 56, and thence to the mounting sleeve B of the antenna. The signal passes up through the impedance coil 30 around the insulating tube C to the whip receiving sleeve A and thence to the whip 16. The whip can be as short as 36 inches depending upon the number of turns of the coil 30, and the length of support pin 12 which projects into opening 20 of the mounting sleeve B. A capacitive coupling is provided between the end of support pin 12 and the tubular upper end of mounting sleeve B which helps to permit shortening of the required length of the whip 16, as does the number of turns of impedance coil 30. Once the relationship is established to give the desired oscillating frequency with the desired length of whip 16, the tuned frequency of the manufactured unit is assured without individual adjustment.

As previously indicated it is contemplated that the antenna will be used as a quarter wave length antenna. The signal from the outer conductor of a driving coaxial cable, not shown, passes through the connector barrel 50 to the angle iron bracket 46 and into the metal of the vehicle on which it is mounted to produce a quarter wave length signal in the metal of the vehicle, which signal is a mirror image of that produced in the antenna itself.

It will now be apparent that the objects heretofore enumerated as well as others have been accomplished, and that a simplified design has been provided in which all of the elements which cause resonance to be achieved with a shortened whip also contribute to the mechanical strength, and ruggedness of the unit.

While the invention has been described in considerable detail, I do not wish to be limited to the particular embodiments shown and described, and it is my intention to cover hereby all adaptations, modifications, and arrangements thereof which come within the practice of those skilled in the art to which the invention relates, and which come within the purview of the following claims.

I claim:

1. An antenna assembly comprising:

an antenna whip attachment sleeve;

a mounting sleeve coaxially aligned with said whip attachment sleeve and axially spaced therefrom; said sleeves having respective axially extending cooperating support openings in their surfaces which face each other;

one of said sleeves having a support pin threaded into its support opening and projecting into the support opening of the other of said sleeves with clearance between all sides of said support opening and pin;

a first laterally extending opening in said one of said sleeves and traversing its support opening;

an insulator sleeve positioned over said pin and disposed in said clearance between said pin and said other sleeve to fix said pin in place;

a helically wound conductor surrounding said insulator sleeve and pin with one end of said helically wound conductor in said first lateral opening and locked in place by said threaded support pin;

a second laterally extending opening in said other sleeve with the other end of said helically wound conductor positioned in said second laterally extending opening; and an axially extending threaded stud locking said other end of said helically wound conductor in said other sleeve.

2. The assembly of claim 1 wherein; said stud projects out of said other sleeve; and a coupling threaded on said stud to lock it in place.

3. An antenna assembly comprising:

a whip attachment sleeve;

a mounting sleeve coaxially aligned with said whip attachment sleeve and axially spaced therefrom; said whip attachment sleeve having a threaded axially extending opening facing said mounting sleeve and a laterally extending opening intersecting its axially extending opening; said mounting sleeve having an axially extending opening facing said whip attachment sleeve, and an axially extending threaded opening in its oppositely facing end; said mounting sleeve having a laterally extending opening intersecting said threaded axially extending opening; an axially extending pin threaded into said threaded axially extending opening of said whip attachment sleeve and projecting into said axially extending opening of said mounting sleeve which faces said whip attachment sleeve with lateral clearance between said pin and mounting sleeve; an insulator tube positioned over said pin and disposed in said clearance between said pin and said mounting sleeve to fix said pin in place;

a helically wound coiled conductor surrounding said insulator tube and pin and extending between said sleeves with one end of said coiled conductor positioned in said laterally extending opening of sad whip attachment sleeve and with the other end of said coiled conductor being positioned in said laterally extending opening of said mounting sleeve;

said pin providing a bearing force against said one end of said coiled conductor to lock it in place; and a threaded antenna mounting stud screwed into said threaded opening of said mounting sleeve to provide a bearing force against said other end of said coiled conductor to lock said coil in place and provide a projecting stud for mounting the antenna.

* * * * *